US007334680B2

(12) United States Patent
Cunningham et al.

(10) Patent No.: US 7,334,680 B2
(45) Date of Patent: Feb. 26, 2008

(54) MODULAR TOOLBOX SYSTEM

(75) Inventors: Ian W. Cunningham, Matthews, NC (US); Craig Roberts, Huntersville, NC (US)

(73) Assignee: Irwin Industrial Tool Company, Freeport, IL (US)

( * ) Notice: Subject to any disclaimer, the term of this patent is extended or adjusted under 35 U.S.C. 154(b) by 402 days.

(21) Appl. No.: 10/655,738

(22) Filed: Sep. 5, 2003

(65) Prior Publication Data

US 2004/0134818 A1 Jul. 15, 2004

Related U.S. Application Data

(60) Provisional application No. 60/440,552, filed on Jan. 15, 2003.

(51) Int. Cl.
*B65D 85/28* (2006.01)

(52) U.S. Cl. ..... 206/372; 312/902; 220/23.86; 220/729; 220/735

(58) Field of Classification Search ..... 206/349, 206/372, 373, 374–379, 557, 561, 564, 504; 312/902; 220/694, 703, 729, 735, 737, 738, 220/740, 23.2, 23.4, 23.86, 914, 23.83; 190/110, 190/111; 224/581, 582, 583
See application file for complete search history.

(56) References Cited

U.S. PATENT DOCUMENTS

| | | | | |
|---|---|---|---|---|
| 417,979 | A | 12/1889 | Borcherdt | |
| 1,669,399 | A | 5/1928 | Tronick | |
| 2,501,879 | A | 3/1950 | Sulentic | |
| D182,126 | S * | 2/1958 | Kontoff | D3/268 |
| 3,321,117 | A | 5/1967 | Hedin | |
| 3,450,302 | A * | 6/1969 | Braught | 220/780 |
| 3,589,554 | A | 6/1971 | Smith | |
| 3,610,409 | A | 10/1971 | Graf | |
| 3,648,830 | A | 3/1972 | Graf | |
| 4,122,925 | A * | 10/1978 | Schultheiss | 190/108 |
| 4,245,422 | A | 1/1981 | Souza | |
| 4,335,487 | A | 6/1982 | DiPierro et al. | |
| 4,531,645 | A | 7/1985 | Tisbo et al. | |
| 4,717,024 | A | 1/1988 | Djezovic | |
| 4,775,072 | A | 10/1988 | Lundblade et al. | |
| 4,836,343 | A * | 6/1989 | Arney | 190/108 |
| 5,022,528 | A * | 6/1991 | Savoy | 206/545 |
| 5,040,834 | A | 8/1991 | Kahl et al. | |
| 5,065,885 | A | 11/1991 | Scaroni | |
| 5,098,235 | A | 3/1992 | Svetlik et al. | |
| 5,114,007 | A | 5/1992 | Chen | |
| D329,747 | S * | 9/1992 | Embree | D3/294 |
| 5,176,281 | A | 1/1993 | Fiore | |
| 5,178,282 | A | 1/1993 | Williams | |
| 5,197,623 | A | 3/1993 | Wang | |
| 5,299,722 | A | 4/1994 | Cheney | |
| D347,324 | S * | 5/1994 | Dickinson | D3/272 |
| 5,386,907 | A | 2/1995 | Kahl et al. | |

(Continued)

*Primary Examiner*—Jacob K. Ackun, Jr.
(74) *Attorney, Agent, or Firm*—Dennis J. Williamson; Moore & Van Allen PLLC

(57) ABSTRACT

A toolbox having modular components for additional storage and functionality includes modular attachments that are adapted to removably fit various attachments, such as a cooler, cup holder, saw blades holder, drill bit holders, and the like. In addition, the toolbox includes a three-quarter length tray that allows the craftsman to overstuff the inside of the toolbox and additional storage compartments in the lid of the toolbox.

8 Claims, 12 Drawing Sheets

U.S. PATENT DOCUMENTS

D362,931 S * 10/1995 Brightbill et al. ..... D32/37
D362,932 S * 10/1995 Brightbill et al. ..... D32/37
D367,360 S 2/1996 Wolff
5,503,571 A * 4/1996 Cheslock ..... 439/501
5,524,761 A 6/1996 Wayman
5,575,401 A 11/1996 Trower et al.
5,601,206 A 2/1997 Haas et al.
5,625,921 A 5/1997 Smith
5,628,443 A * 5/1997 Deutsch ..... 224/583
5,680,932 A 10/1997 Dickinson et al.
5,685,421 A 11/1997 Gilmore
5,713,468 A 2/1998 Streichan
5,715,968 A * 2/1998 Fink et al. ..... 220/669
D394,955 S 6/1998 Dickinson et al.
5,758,769 A 6/1998 Vasudeva
5,762,411 A 6/1998 Yemini
5,779,047 A 7/1998 Darrah
5,803,254 A 9/1998 Vasudeva
5,826,718 A 10/1998 Ahern, Jr. et al.
5,873,463 A 2/1999 Purcell
5,878,757 A 3/1999 Hernandez
5,881,874 A * 3/1999 McKinney ..... 206/315.11
5,881,932 A * 3/1999 Wadden ..... 224/153
5,882,097 A 3/1999 Kohagen et al.
5,887,715 A 3/1999 Vasudeva
5,887,745 A 3/1999 Wood
D408,634 S 4/1999 Shabestari
5,915,554 A 6/1999 Hung
6,039,205 A * 3/2000 Flink ..... 220/659
D425,275 S * 5/2000 Delouvre et al. ..... D32/37
6,059,135 A * 5/2000 James et al. ..... 220/23.4
6,082,539 A 7/2000 Lee
6,105,767 A 8/2000 Vasudeva
6,105,844 A 8/2000 Walters et al.
D431,699 S * 10/2000 Sofy ..... D32/37
6,129,400 A 10/2000 Jakubiec et al.
6,138,827 A * 10/2000 Marshall ..... 206/373
6,237,765 B1 5/2001 Hagen et al.
6,237,776 B1 * 5/2001 Mogil ..... 206/579
6,360,884 B1 * 3/2002 Smith et al. ..... 206/209.1
6,371,321 B1 * 4/2002 Lee ..... 220/23.4
6,585,942 B1 7/2003 Bussell et al.
6,626,295 B1 * 9/2003 Vasudeva ..... 206/373
6,769,542 B2 * 8/2004 Polito ..... 206/361
6,910,577 B2 * 6/2005 O'Sullivan ..... 206/373
2002/0015538 A1 2/2002 Snider
2002/0070137 A1 6/2002 Hedges
2002/0117414 A1 8/2002 Kipper et al.
2002/0125160 A1 9/2002 Itzkovitch
2003/0015445 A1 1/2003 Levy
2003/0075468 A1 4/2003 Story et al.
2003/0106821 A1 6/2003 Bar-Erez

* cited by examiner

MODULAR TOOLBOX SYSTEM

RELATED APPLICATIONS

This application claims priority from provisional application 60/440,552, MODULAR TOOLBOX SYSTEM, filed on Jan. 15, 2003, the entirety of which is incorporated herein by reference.

BACKGROUND OF THE INVENTION

When using, storing or transporting tools, it is desirable to keep them organized and ready for use. Various prior art toolboxes and carrying cases have been designed with varying organizing configurations.

In order to keep the tools organized and protected, it is often desirable that the individual tools have separate storage compartments. In addition to individual compartments, it is also desirable that the toolbox be versatile and able to adapt to the individualized needs of the craftsman.

In prior toolbox designs, various containers and compartments have been provided. However, in these configurations, the user will be unable to change the configuration of the toolbox to allow for storage of other items that may not fit into the original containers and compartments.

Many craftsmen also carry their toolboxes by hand. The boxes can be very heavy and cumbersome. It would be desirable for a toolbox to be adapted to the user. For example, when carried at the user's side, conventional toolboxes may bump and hit the user's leg as they walk. It would be desirable for the toolbox to reduce this tendency.

BRIEF SUMMARY OF THE INVENTION

The present invention provides a portable modular toolbox system for craftsmen and the like wherein the toolbox has added modular storage in the lid and in the modular attachments. Also, the structural foam construction eliminates the need for rivet holes, thereby providing the toolbox assembly with water resistance superior to the conventional toolbox assembly.

One embodiment of the present invention includes a toolbox system including a main compartment defined by a base, two opposed side walls, and two opposed end walls, the side walls and the end walls upstanding from the base to form an interior cavity, a lid hingedly attached to one of the side walls, and at least one modular attachment removably secured by mounting tangs to at least one of the side walls or end walls.

The main compartment is created from a base and four upstanding side walls. These walls define the interior cavity of the toolbox. Optionally, the main compartment includes various tool trays and compartments within the cavity. One such embodiment includes a tray covering three-quarters of the length of the cavity.

The lid of the toolbox is hingedly attached to the main compartment along one of the side walls. When in a closed position, the lid covers the open main compartment and is secured to the main compartment by latches. The lid also includes a handle which is overmolded with rubber. The overmolding increases the comfort of the user when transporting or moving the toolbox. In addition, the lid includes individual compartments to allow the user additional storage.

Another embodiment of the present invention includes a toolbox system having a main compartment defined by a base, a first side wall, a second side wall, and two opposed end walls, the side walls and the end walls upstanding from the base to form an interior cavity, a lid having side edges corresponding to the first and second side walls and the being hingedly attached to the first side wall, and a portion of the second side wall and the corresponding lid edge having a concave outer surface. The concave outer surface allows the user to easily carry the toolbox against their leg.

The present invention also includes modular attachments which are removably secured to at least one of the two opposing end walls. The modular attachments of the toolbox give the craftsman increased versatility when using the toolbox by allowing the user to choose what tools or accessories he or she wishes to securely store.

The modular attachments are snap-fitted to the main compartment of the toolbox using mounting tangs protruding from the upper and lower surfaces of the attachment. The tangs secure the attachment by fitting in to corresponding female recesses on the main compartment of the toolbox. Furthermore, the end walls may have a recessed surface which may be defined by at least three inner surfaces, two of which face each other. This recessed surface, desirably, corresponds to the shape of the modular attachment, providing increased stability.

Another aspect of the current invention includes a method of carrying a tool box comprising the steps of providing a toolbox comprising a lid with a handle, a main compartment defined by a base, a first side wall, a second side wall, and two opposed end walls, the side walls and the end walls upstanding from the base to form an interior cavity, the second side wall and a corresponding lid edge having a concave outer surface portion, and carrying said toolbox so that a leg of a user is positioned along the concave surface portion of the second side wall and the corresponding lid edge.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE INVENTION

A toolbox of the present invention may include a main compartment, a lid, and at least one modular attachment. The toolbox may include one or more inner removable trays which are supported by the interior surfaces of the walls of the main compartment. It is understood by those of skill in the art that the modular toolbox system of the present invention could be adapted to fit and receive various types of tools or tool parts. These components can be made of any material, but are preferably and easily manufactured of structural foam materials.

Figure 1:
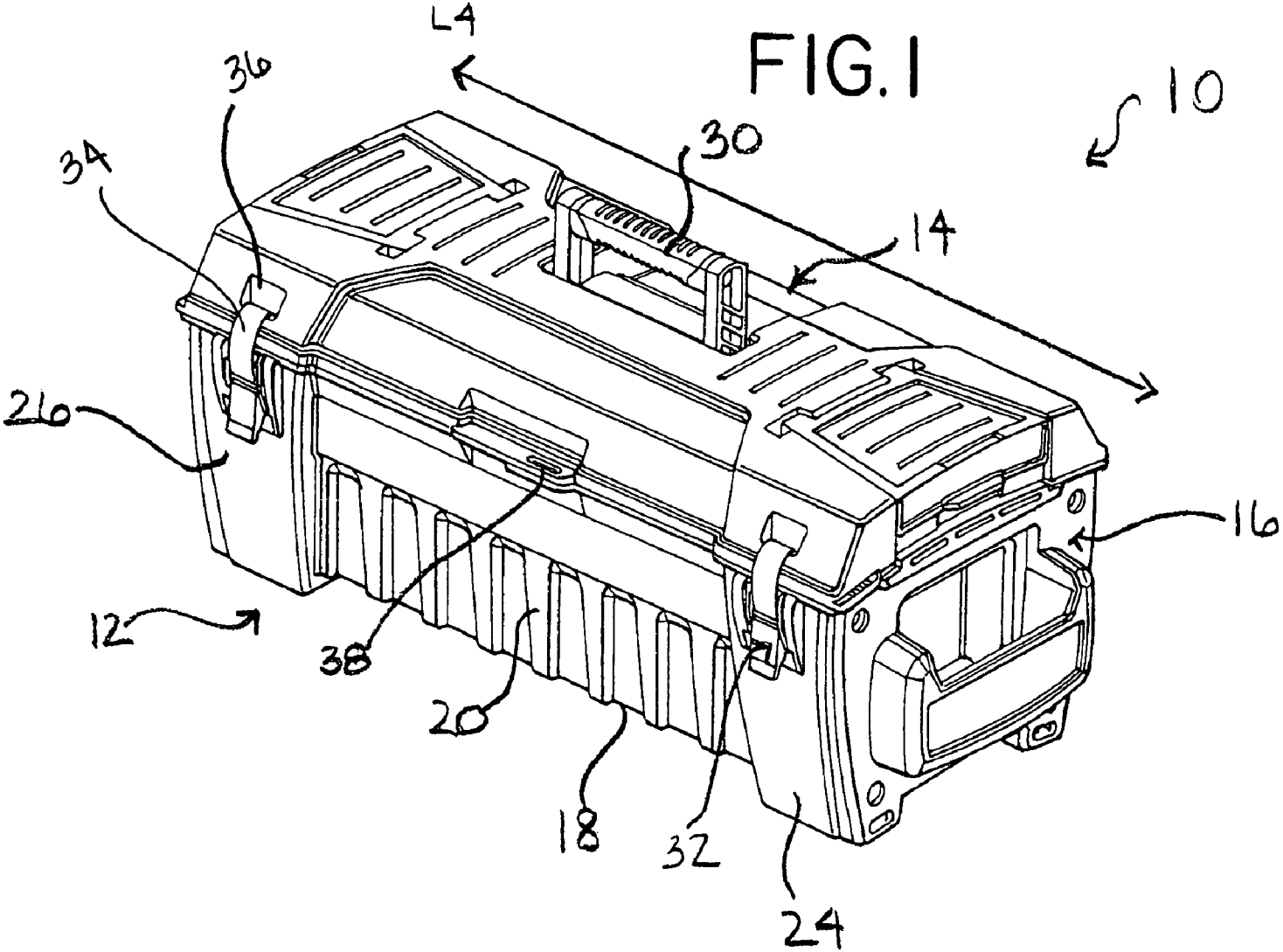
FIG. 1 is perspective view of an embodiment of the modular toolbox system of the present invention.

FIG. 1 shows an embodiment of the toolbox system 10 of the present invention in a closed configuration. The toolbox system may be any shape, but is preferably square or rectangular. For the purposes of this application, and the figures, the toolbox of the present invention will be described as being rectangular in shape.

Looking specifically at the components of this embodiment, the toolbox 10 may include a main compartment 12, a lid 14, and at least one modular attachment 16. As such, the main compartment 12 is desirably defined by a base 18 and four upstanding walls. The walls preferably include two opposed side walls 20 and 22 and two opposed end walls 24 and 26.

The main compartment 12 is desirably hingedly attached to the lid 14 of the toolbox 10 along one of the side walls 22. The hinge 28 (shown in FIGS. 2 and 3) that attaches the lid 14 and the main compartment 12 may be of known configuration. The hinge 28 allows the lid 14 to open and close with respect to the main compartment 12.

A handle 30 is attached along the length L4 of the lid 14, at approximately the center portion of the top surface of the lid 14. The handle 30 is desirably overmolded with rubber for the user's added comfort. In order to carry the toolbox 10 by the handle 30, the lid 14 is secured in the closed position by latching mechanism 32.

The latching mechanism 32 may include a solid lip and latch section 34 which is mounted on the outer surface of the side wall 20 not having the hinge 28. The solid lip section 34 allows the craftsman to easily lift the latch 32 and open the lid 14. A mating latch receiving recess 36 is formed within the side surface the lid 14. The toolbox 10 preferably includes lock receiving apertures 38 in the lid 14 and the main compartment 12. These apertures 38 allow the toolbox user to insert a lock or safety mechanism, such as a pad lock or combination lock.

Also shown in FIG. 1 are modular attachments 16 that are removably attached to one of the end walls 24 and 26. In other embodiments, the modular attachments can be attached to sidewalls using similar mounting mechanisms described below. The modular attachments 16 increase the versatility of the toolbox 10 and allow the user or the manufacturer to customize the toolbox 10 for their intended use. The modular attachments 16 will be described in greater detail below.

Figure 2:
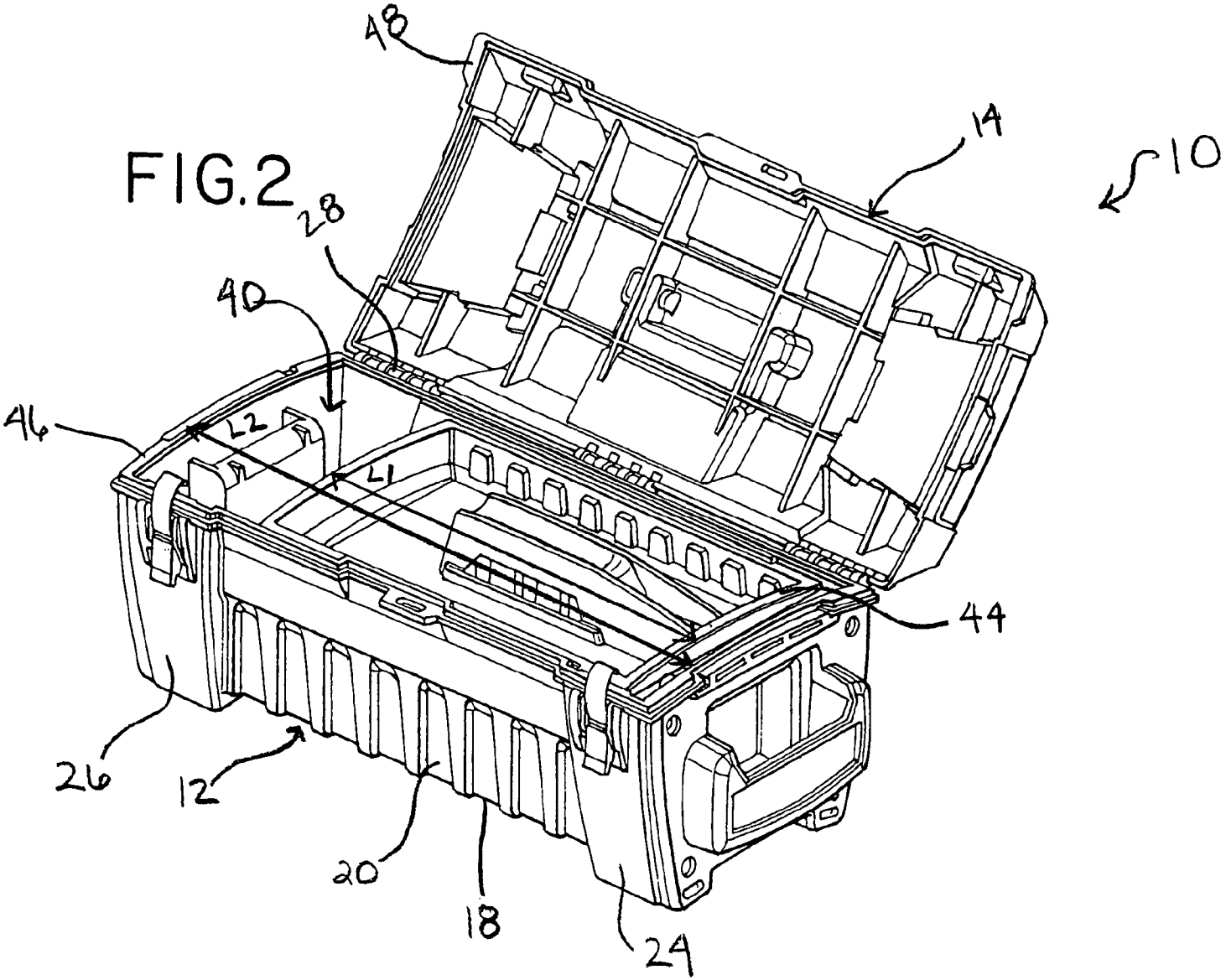
FIG. 2 is a perspective view of the embodiment of FIG. 1 the present invention in an open position.
Figure 3:
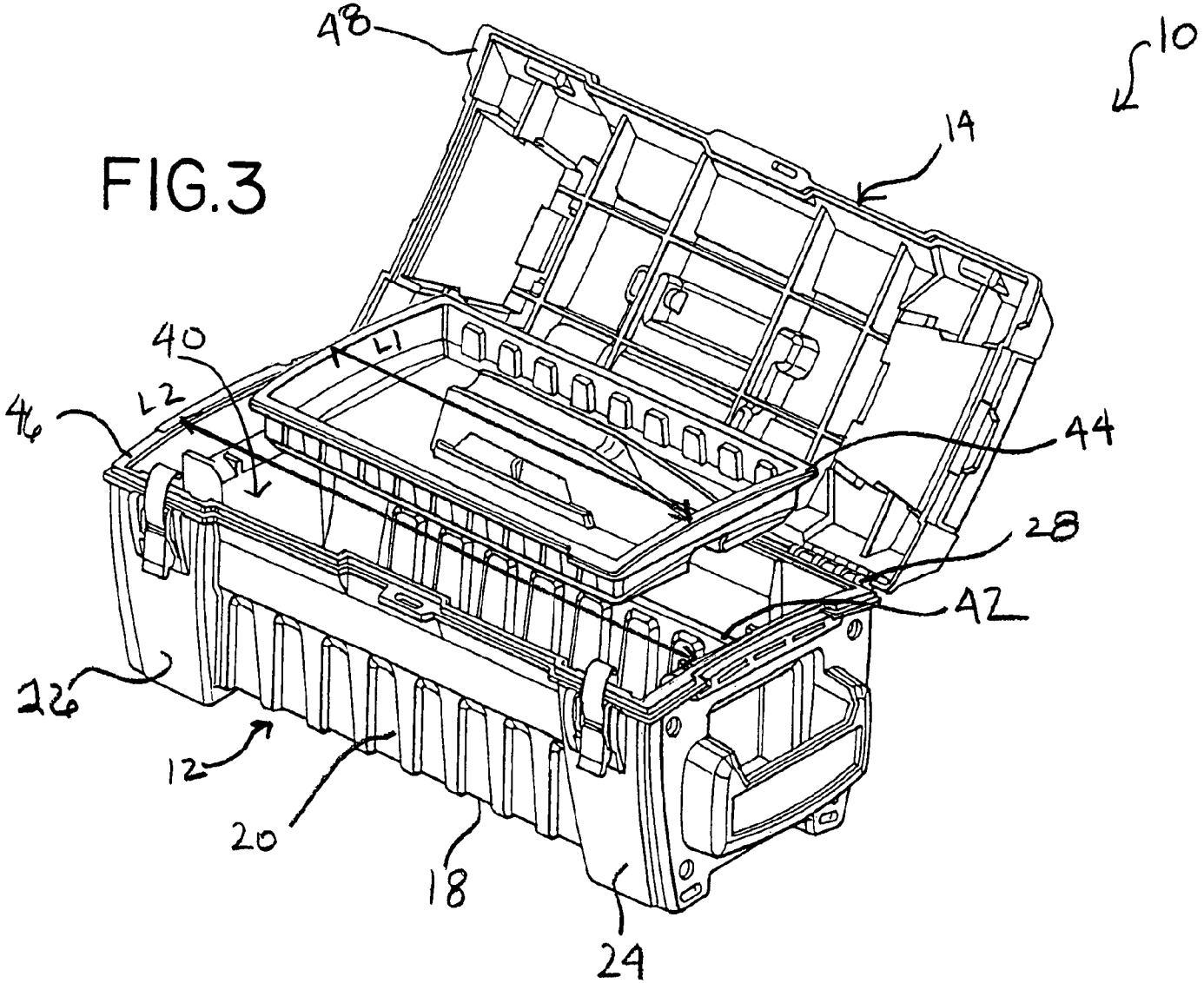
FIG. 3 is an exploded view of the embodiment of FIG. 1 in an open position.

FIGS. 2 and 3 show the embodiment of FIG. 1 with the lid 14 in an open position. As shown, the side walls 20 and 22 (not shown) and end walls 24 and 26, upstanding from the base 18 of the toolbox 10, define an interior cavity 40 within the main compartment leaving an opening through which materials, such as tools, may be received. The interior cavity 40 may include protrusions or interior ledges 42 (best shown in FIG. 3) on the inside surfaces of the side and/or end walls. These ledges 42 are positioned to hold a suspended tray 44 within the interior cavity 40. In one embodiment of the present invention, the length L1 of the tray 44 may be approximately three-quarters the length L2 of the interior cavity 40. This embodiment allows the user to shift the tools stored in the toolbox 10 and to overstuff the portion of the interior cavity 40 that is uncovered by the tray 44.

In another embodiment of the present invention, the three-quarter length tray may be secured to the inside of the main compartment by snapping together female recesses disposed along the inner surface of the main compartment and male protrusions disposed along the corresponding outer surfaces of the tray (not shown).

The main compartment 12 and the lid 14 may each include a peripheral skirt 46 and 48. The peripheral skirt 46 of the main compartment 12 extends outwardly, forming a lip or flange that extends slightly over the side walls 20 and 22 and end walls 24 and 26. The lip of flange may be reinforced by increased thickness. The peripheral skirt 48 of the lid 14 extends downwardly from the lid 14 and rest on the skirt 46 of the main compartment 12 when the lid 14 is closed thereon.

As described above, the lid 14 of the toolbox 10 is hingedly attached to a side wall 26 of the main compartment 12. The lid 14 is designed to cover the interior cavity 40 of the main compartment 12. The lid 14 is hingedly attached to one of the opposed side walls 26 and the corresponding portion of the lid 14. The lid 14 is attached by means of standard type hinges 28. FIG. 3 is an exploded view of the toolbox 10 of FIG. 2 and like parts are similarly numbered.

Figure 4:
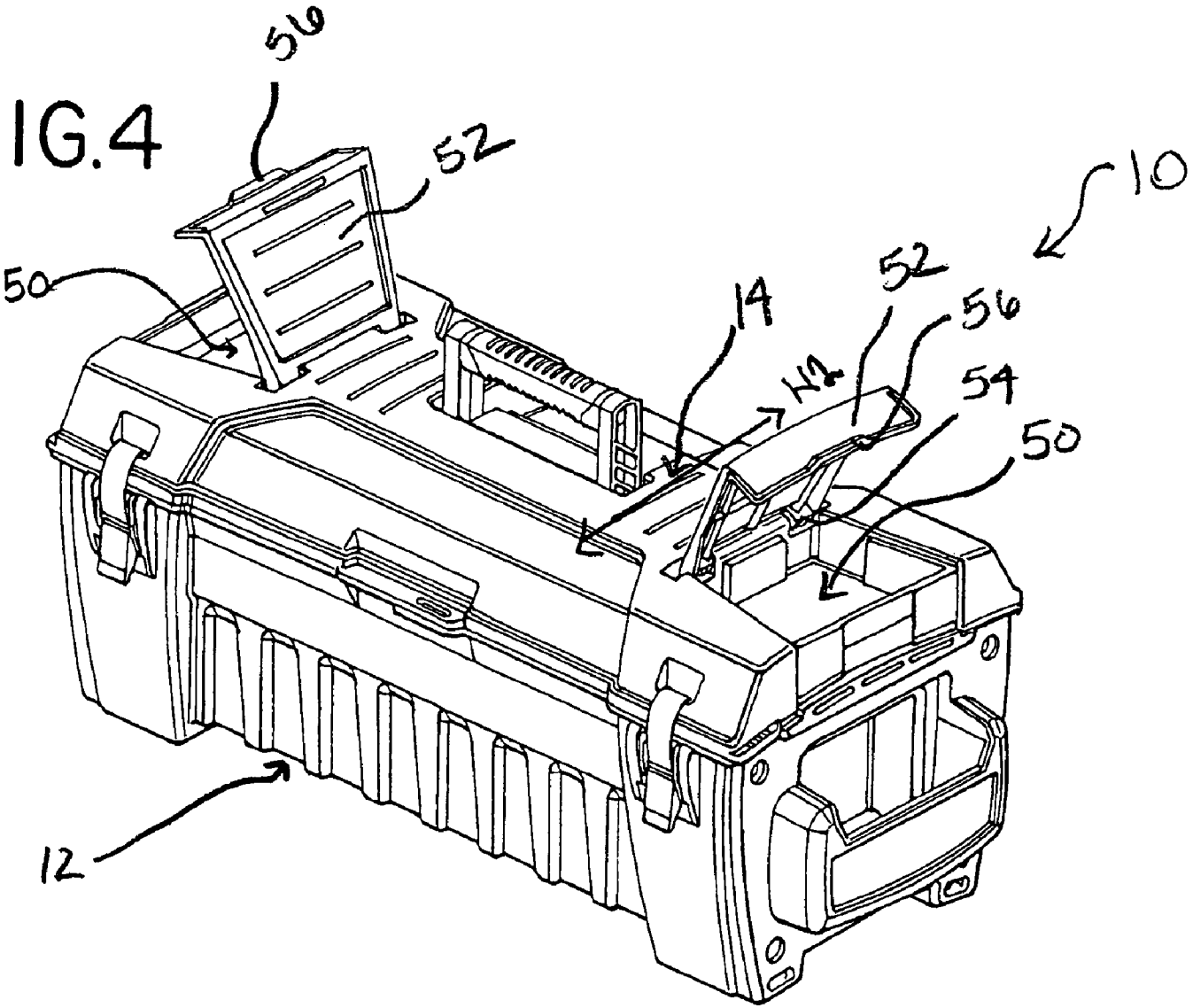
FIG. 4 is a top perspective view of the embodiment of FIG. 1.

FIG. 4 is a top perspective view of the toolbox 10 of FIG. 1. FIG. 4 shows auxiliary storage compartments 50 that may be added to the top of the toolbox lid 14. The storage compartments 50 are defined by recesses formed within the lid 14. This allows the user to store additional tools or tool parts, for example, without taking up much needed space in the main compartment 12 of the toolbox 10. The storage compartments 50 are covered by removable covers 52 that are connected to the top surface of the lid 14 by compartment hinges 54. These compartment hinges 54 are desirably disposed along the width W2 of the lid 14. The edge of the cover that is opposite the compartment hinges 54 includes a snap-fit closing mechanism 56 that secures the cover 52 to the surface of the lid 14. In other embodiments, covers need not be hinged.

Figure 5:
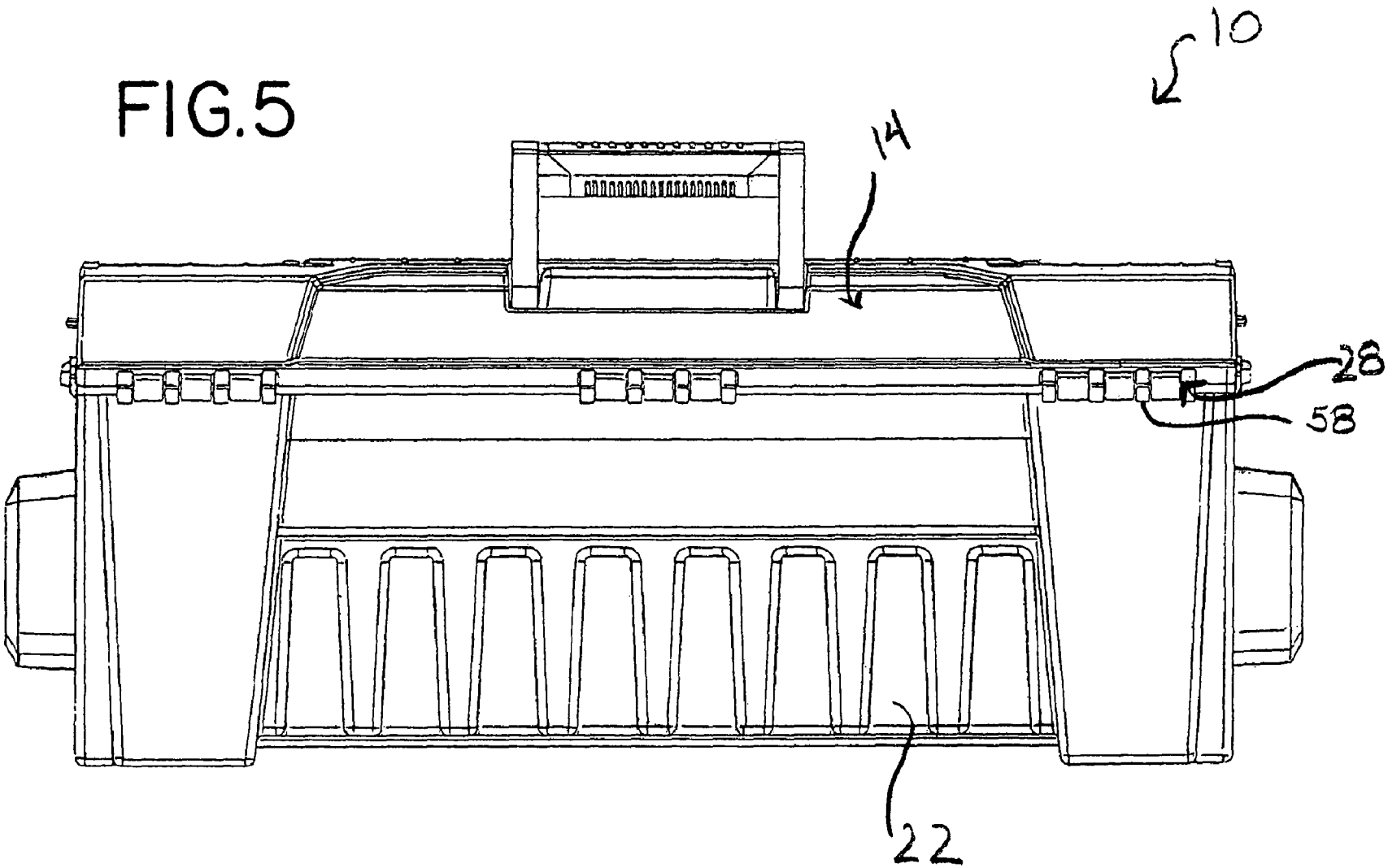
FIG. 5 is a back view of the embodiment of FIG. 1 the present invention.

FIG. 5 shows an embodiment of the toolbox 10 of the present invention from the back. The back of the toolbox 10 is generally considered the side wall 22 which is hingedly secured to the lid 14. The hinge 28 of the present invention may include lid support arms 58. Lid support arms 58 limit the outward movement of the lid 14, maintaining the lid 14 in a desirably open position.

Figure 6:
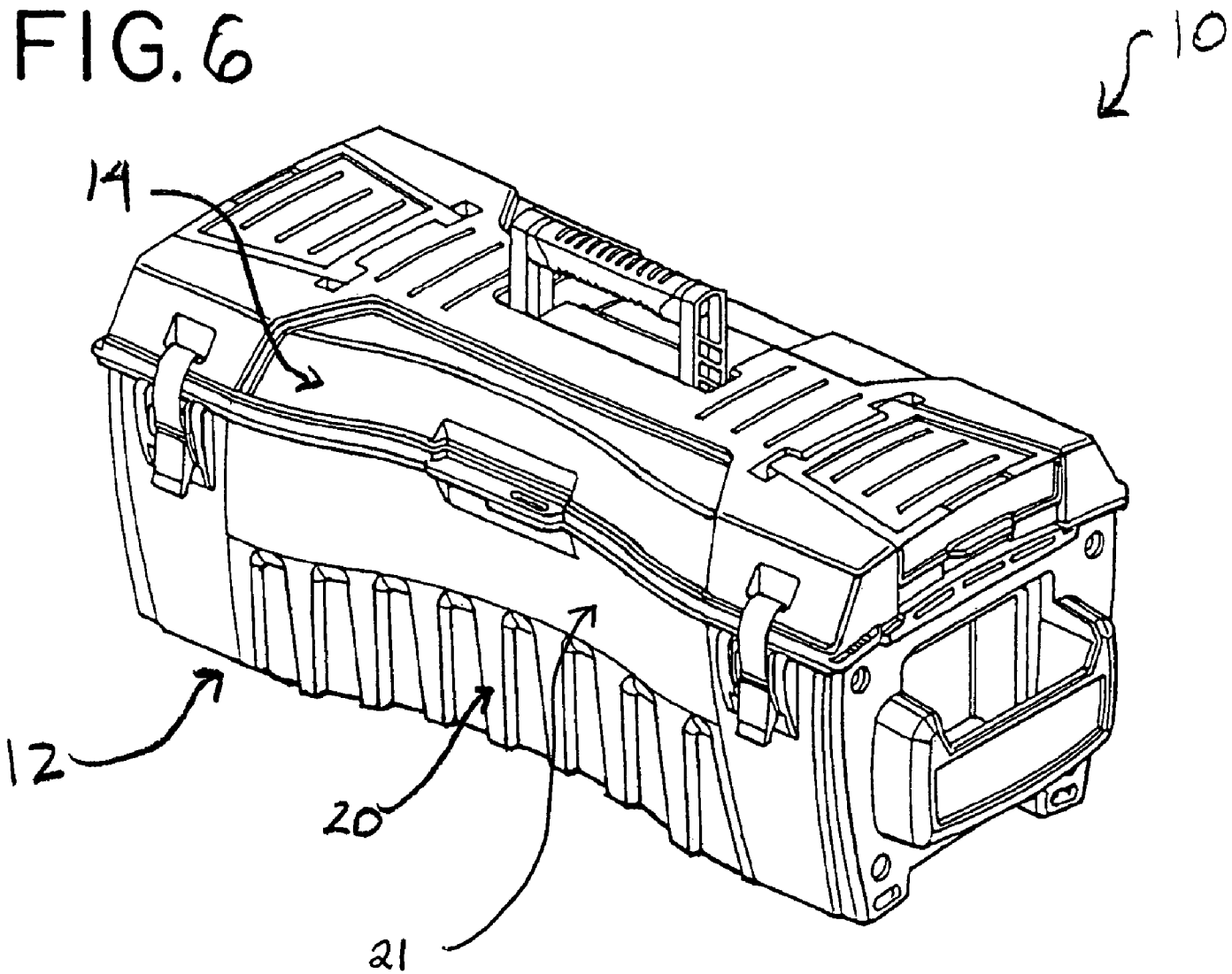
FIG. 6 is a perspective view of an embodiment of the present invention including.

In yet another embodiment of the current invention, a portion of the side wall 20 of the main compartment 12 and the corresponding portion of the lid 14 may be contoured to conform generally to the shape of a human leg, hip, or thigh. As shown in FIG. 6, this feature allows the craftsman to carry a conceivably very heavy toolbox comfortably alongside his or her body. Typically, as shown in FIG. 6, the side wall 20 that does not include a hinge 28 has a generally concave portion 21. The concave portion will desirably curve inwardly toward the inner cavity of the main compartment 12. The corresponding portion of the lid 14 will have a matching shape or contour. Typically, the concave portion will be integrally molded with the main compartment. The concave feature may also have angled surfaces.

Also note that this feature may be implemented on conventional toolboxes without modular features.

Figure 7:
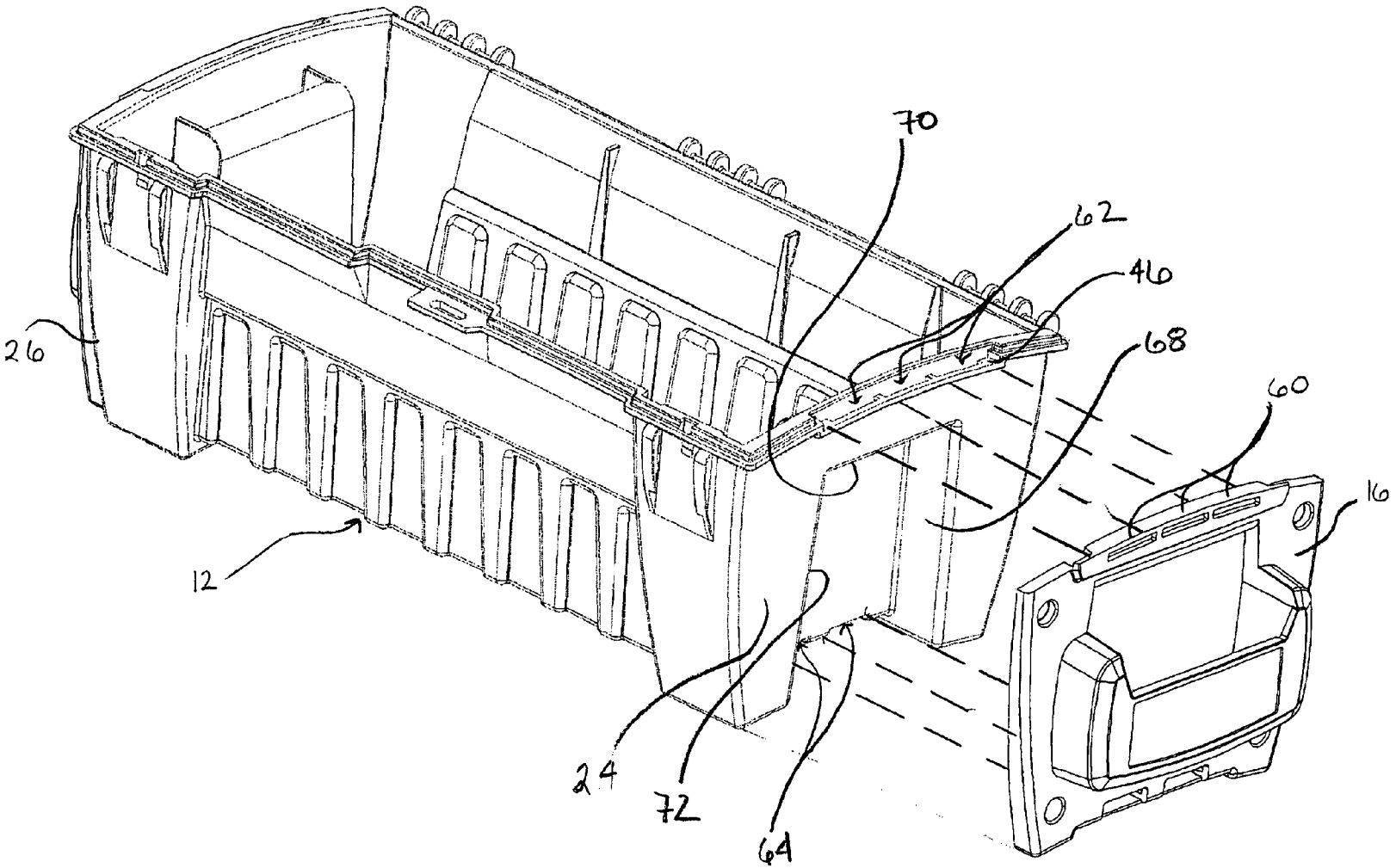
FIG. 7 is an exploded perspective view of the end cap and example of a modular attachment of FIG. 1 the present invention.
Figure 8:
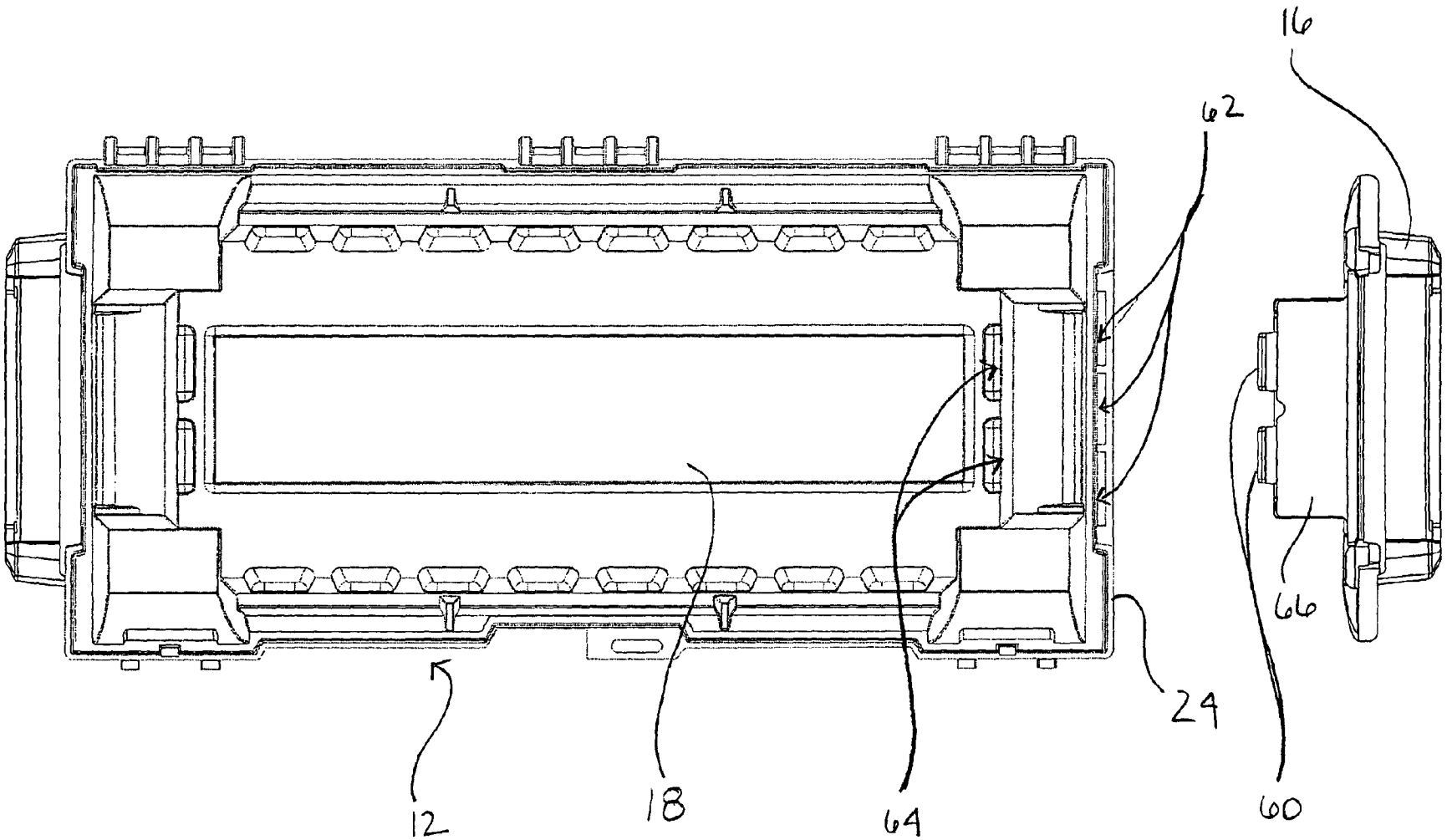
FIG. 8 is an exploded top view of the end cap and example of a modular attachment of FIG. 1 the present invention.

Referring now to FIGS. 7 and 8, the main compartment 12 is constructed to hold various modular attachments 16 that a craftsman might find useful. The attachments 16 are generally held adjacent the end walls 24 and 26 of the main compartment 12, but it is conceivable that the compartments 16 may be attached elsewhere on the toolbox 10.

The modular attachments 16 are snap-fit contiguous with the end walls 24 and 26 of the main compartment 12. Desirably the modular attachments 16 include mounting tangs 60 that extend from the top and bottom surfaces of attachment 16. The tangs 60 snap-fit into corresponding female recesses 62 and 64 within the end walls 24 and 26 of the main compartment 12. The structural foam construction of the main compartment 12, lid (not shown), and attachments 16 allows the tangs 60 to flex locally to fit securely within the upper and lower corresponding recesses 62 and 64.

As shown in FIG. 7, the main compartment 12 may include upper female recesses and lower female recesses. The upper female recesses 62 are disposed in the end wall 24 and/or 26 portion of main compartment's peripheral skirt 46. They are desirably located toward the center of the end wall. FIG. 8 shows the lower female recesses 64, desirably disposed within the base 18 of the main compartment 12, toward the center of the end wall 24 and/or 26. The corresponding lower set of mounting tangs 60 protrudes upwardly from an extension 66 that extends from the bottom surface of the modular attachment 16.

Figure 9:
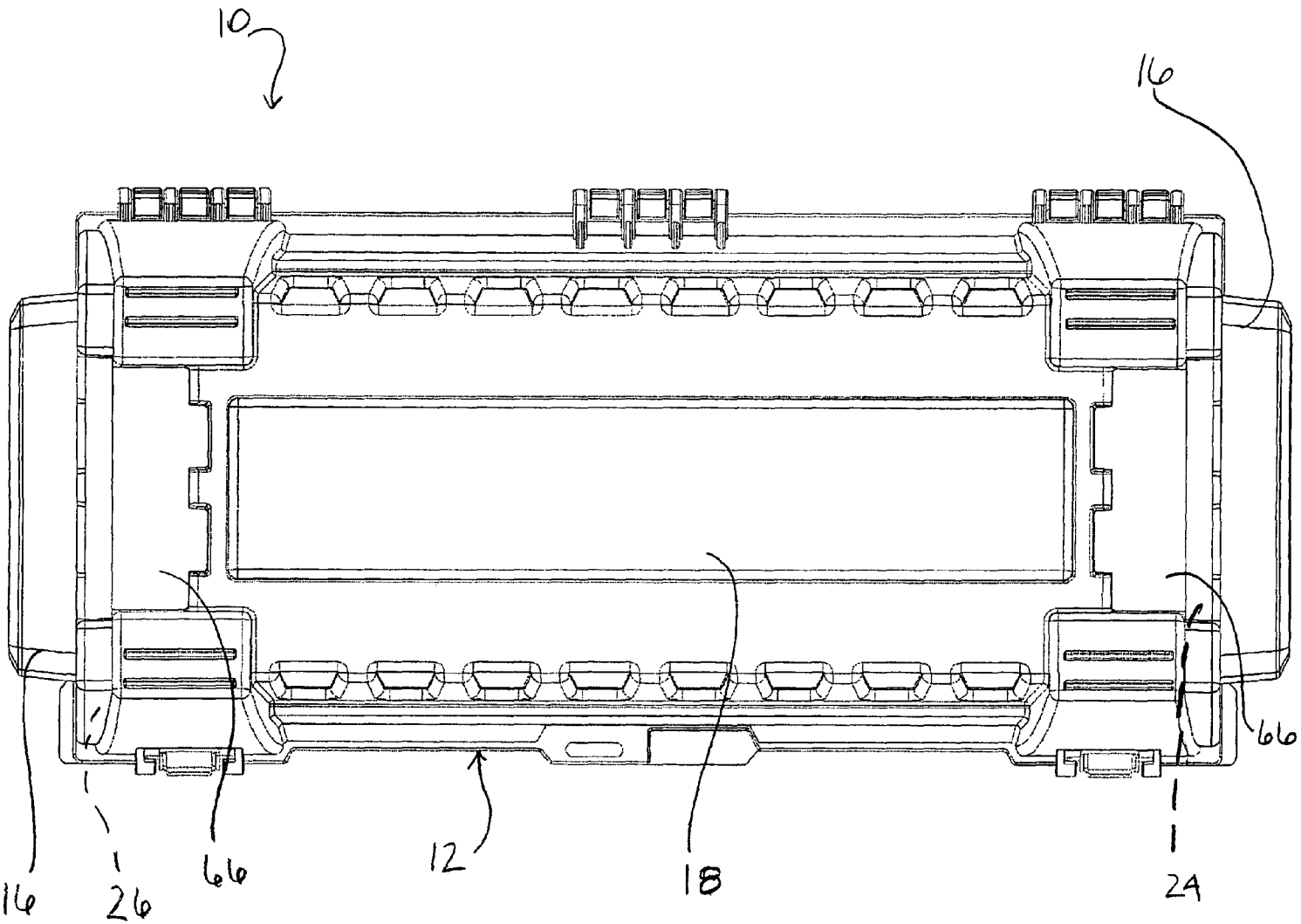
FIG. 9 is a bottom view of the embodiment of FIG. 1 the present invention.

FIG. 9 is a bottom view of the toolbox 10 of the present invention with a modular attachment 16 securely fitted to the main compartment 12 of the toolbox 10. When the attachment 16 is secured to the main compartment 12, a portion of the extension 66 will extend to cover the bottom or the end wall 24 and/or 26 and will be adjacent the bottom surface of the main compartment's base 18. This extension 66 provides increased stability and support for the attachment 16.

Referring again to FIG. 7, in one embodiment, the modular attachment 16 is a carrying box or pocket for tools and the like. The attachment 16 includes an end wall-facing surface that fits flush against the recessed surface of the end wall 24 or 26. This feature provides added stability and aids the mounting tangs 60 in securing the modular attachment 16 to the main compartment 12.

For example, the surface of the end walls 24 and 26 may be recessed so that the surface of the end wall has a shape corresponding to the shape of the modular attachment 16. By creating at least three inner surfaces 68, 70, 72 within the end walls 24, 26, two of which surfaces face each other, the modular attachment 16 fits securely within the end walls 24, 26. The recessed surfaces have various shapes, but desirably the outer surface of the end wall 24 and 26 is arc-shaped or generally rectangular in section.

In other embodiments, additional accessory or tool holders may be affixed to the ends of the toolbox by placing the female recesses in the three inner walls of the end wall, rather than in the skirt and the base.

The user of the toolbox may carry the toolbox of FIG. 6 at his or her side. A method for carrying the toolbox in this manner is provided. The method includes providing the toolbox of the afore described embodiment, wherein the concave outer surface portion at least partially conforms to a user's leg.

The toolbox, as shown in any of the above described figures, can be used for a variety of different purposes. As the purpose and needs of the user change, so can the modular attachments that are removably attached to the end or side walls of the main compartment. The user may remove the modular attachment from the end or side wall of the main compartment and replace it with a second, different, attachment.

Figure 10:
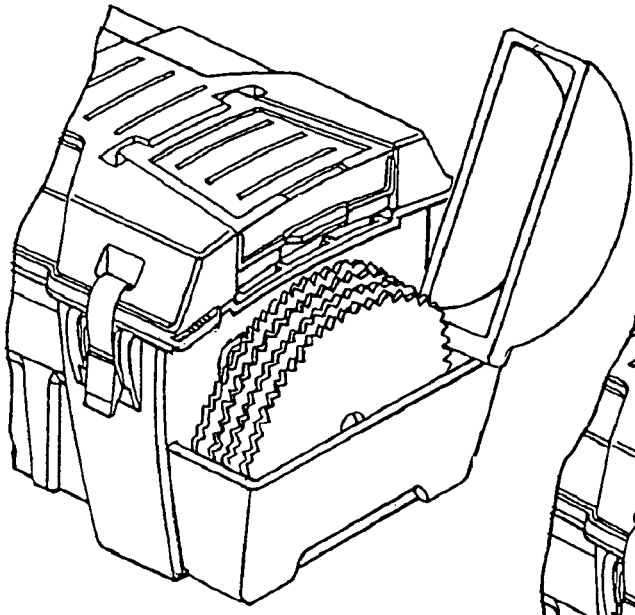
FIGS. 10-21 are perspective views of the embodiment of FIG. 1 with various end cap embodiments.
Figure 11:
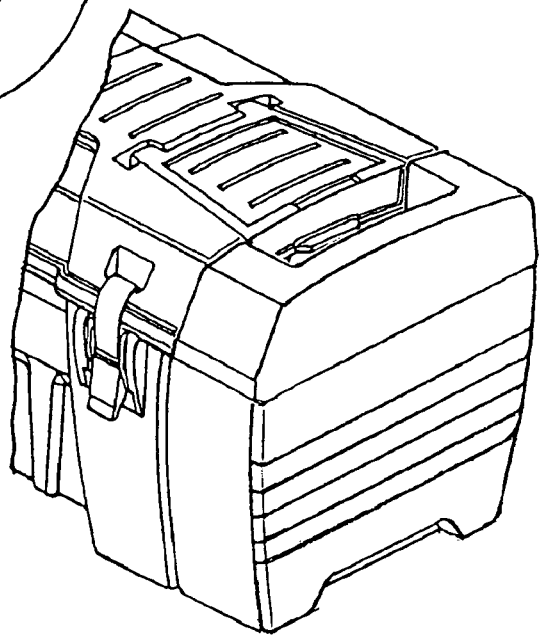
Figure 12:
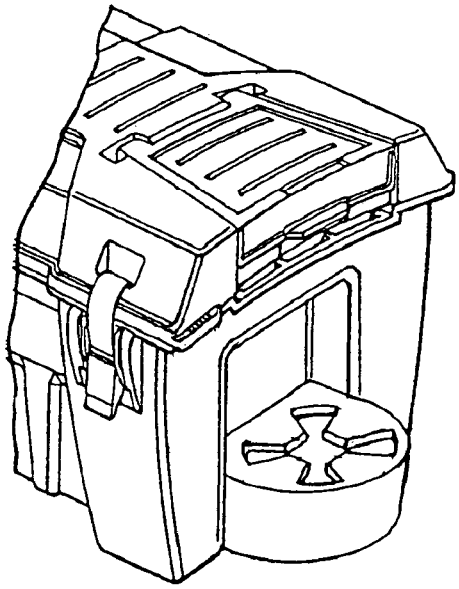
Figure 13:
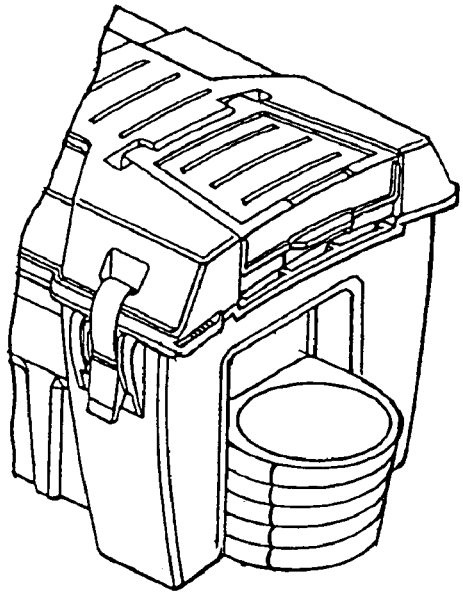
Figure 14:
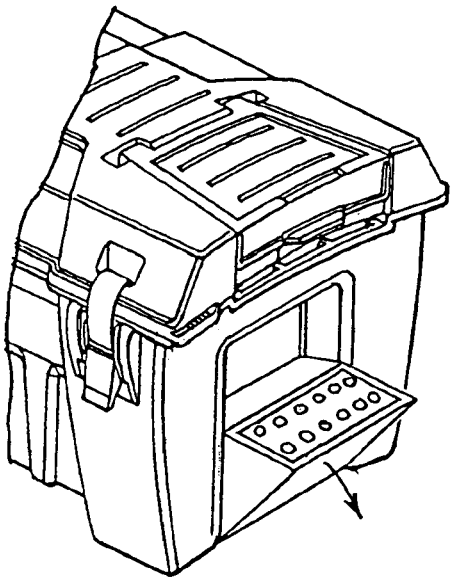
Figure 15:
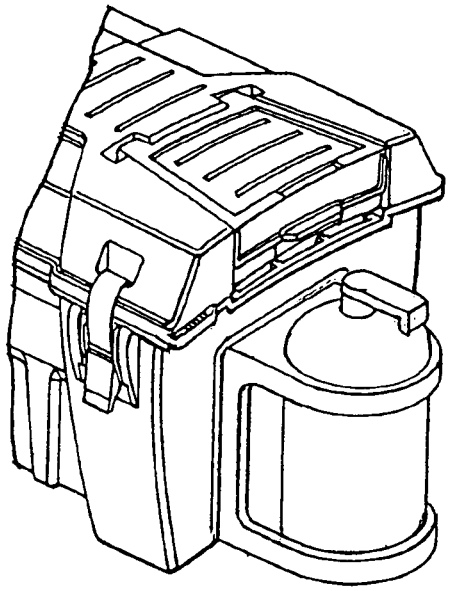
Figure 16:
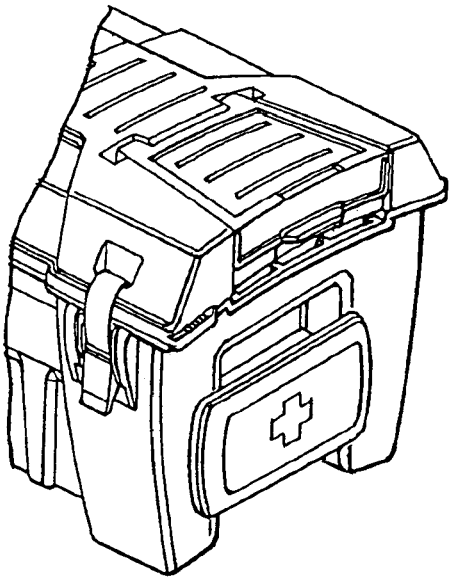
Figure 17:
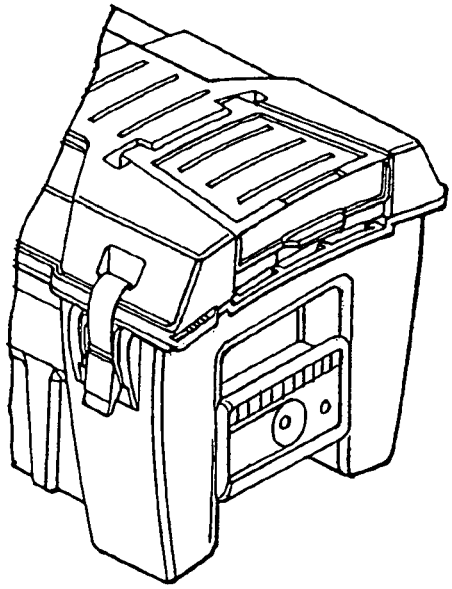
Figure 18:
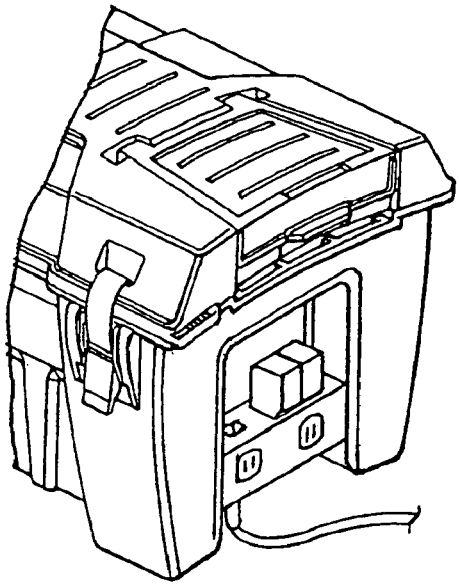
Figure 19:
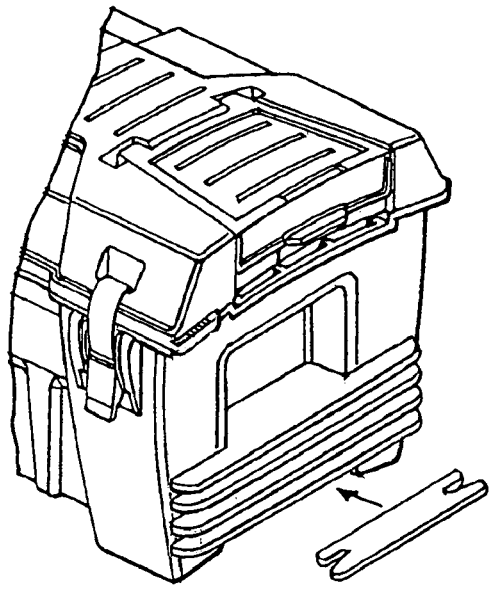
Figure 20:
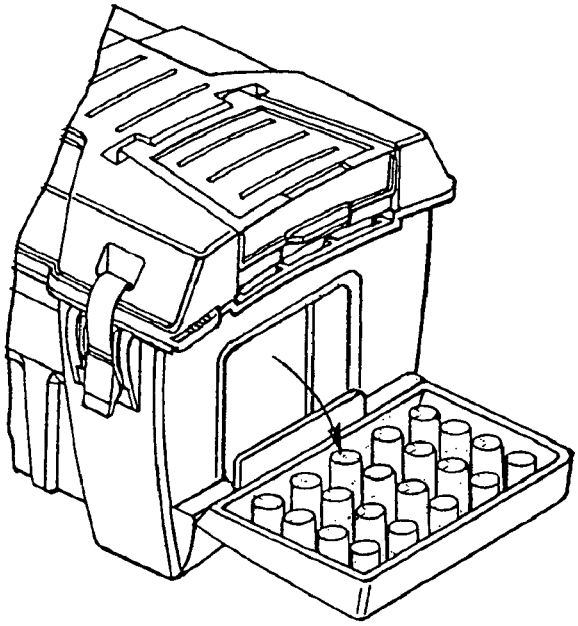
Figure 21:
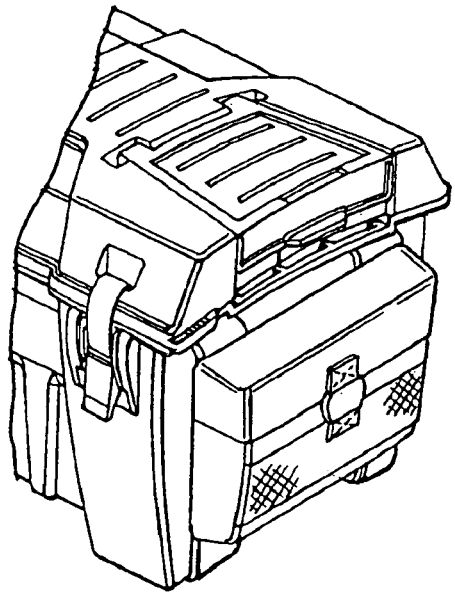

For example, FIG. 10 shows modular attachment that may be removably secured to the main compartment of the presently described toolbox for holding circular saw blades. FIG. 11 shows a modular attachment including a cooler. FIG. 12 shows a modular attachment that can be used as a cup holder. FIG. 13 shows a modular attachment for holding compact disks or sanding disks. FIG. 14 shows a modular attachment for containing drill bits and the like. FIG. 15 shows a modular attachment for carrying a spray can or fire extinguisher. FIG. 16 shows a modular attachment for holding a first aid kit. FIG. 17 shows a modular attachment for holding flash lights or a radio. FIG. 18 shows an attachment for holding a rectangular batter or a power strip along the end wall of the present invention. FIG. 19 shows a modular attachment for holding reciprocal saw blades. FIG. 20 shows a modular attachment suitable for storing sockets. FIG. 21 shows a modular attachment that includes a soft storage pouch or attachment.

It is intended that the foregoing detailed description be regarded as illustrative rather than limiting, and that it be understood that the following claims, including all equivalents, are intended to define the scope of this invention.

The invention claimed is:

1. A toolbox system comprising:

a main compartment having a first configuration defined by a base, two opposed side walls, and two opposed end walls, the side walls and the end walls upstanding from the base to form an interior cavity for retaining tools, the side walls, the end walls and the base being formed of a rigid material;

a lid hingedly attached to one of the side walls and a handle attached to the lid for carrying the toolbox; and, at least one modular attachment having a second configuration different than said first configuration and being smaller than said main compartment, said modular attachment removably secured to at least one of the side walls or end walls such that when secured to said at least one of the side walls or end walls expands the volume of the toolbox, said modular attachment including a portion that extends under said main compartment and is coextensive with the base when the modular attachment is secured to the base such that the modular attachment is supported by said portion.

2. The toolbox system of claim 1, further including mounting tangs disposed at an upper surface and a lower surface of the at least one modular attachment.

3. The toolbox system of claim 1, wherein the lid and at least one of the side walls have corresponding concave outer surfaces.

4. The toolbox system of claim 3, wherein the lid further includes at least one storage compartment that may be accessed when the lid is in a closed position and at least one cover for said storage compartment.

5. The toolbox system of claim 1 wherein said at least one modular attachment being selected from the group of a saw blade holder, a cooler, a cup holder, a disk holder, a drill bit holder, a radio holder, a flashlight holder, a power strip holder, or a battery holder.

6. A toolbox system comprising:

a main compartment defined by a base, two opposed side walls, and two opposed end walls, the side walls and the end walls upstanding from the base to form an interior cavity;

a lid hingedly attached to one of the side walls; and, a modular attachment removably secured to at least one of the side walls or end walls, the modular attachment is secured to the one of the side walls or end walls by a first female recess formed along one edge of the modular attachment or one edge of the one of the side walls or end walls and a second female recess formed along another edge of the modular attachment or another edge of the one of the side walls or end walls and a first male tang formed along one edge of the other of the modular attachment or one edge of the other of the one of the side walls or end walls and a second male tang formed along another edge of the other of the modular attachment or another edge of the other of the one of the side walls or end walls, said first and second tangs engaging the first and second female recess, wherein the first and second recesses and first and second tangs comprise flexible material that flexes to allow the first and second tangs to fit securely within the first and second recesses.

7. A toolbox system comprising:

a main compartment having a first configuration defined by a base, two opposed side walls, and two opposed end walls, the side walls and the end walls upstanding from the base to form an interior cavity for retaining tools;

at least one the side walls or end walls including a recess said recess having a shape;

a lid hingedly attached to one of the side walls; and, at least one modular attachment having a second configuration different than said first configuration and being smaller than said main compartment, said modular attachment removably secured to at least one of the side walls or end walls such that when secured to said at least one of the side walls or end walls expands the volume of the toolbox, said modular attachment including a portion that is coextensive with the base such that the modular attachment is supported by said portion and said modular attachment having a peripheral shape that closely corresponds to said shape such that said modular attachment fits securely within said recess, wherein the modular attachment includes an extension extending from the lower surface of the attachment and the mounting tangs protruding upwardly from the extension.

8. A toolbox system comprising:

a main compartment having a first configuration defined by a base, two opposed side walls, and two opposed end walls, the side walls and the end walls upstanding from the base to form an interior cavity for retaining tools;

a lid hingedly attached to one of the side walls; and, at least one modular attachment having a second configuration different than said first configuration and being smaller than said main compartment, said modular attachment removably secured to at least one of the side walls or end walls by mounting tangs wherein the modular attachment includes an extension extending from the lower surface of the attachment and the mounting tangs protruding upwardly from the extension such that when secured to said at least one of the side walls or end walls expands the volume of the toolbox, said modular attachment including a portion that is coextensive with the base such that the modular attachment is supported by said portion.

* * * * *